US005509181A

United States Patent [19]

Yuuki et al.

[11] Patent Number: 5,509,181

[45] Date of Patent: Apr. 23, 1996

[54] FITTING FOR BALL CHAINS

[75] Inventors: Kenji Yuuki, Toyama; Kiyoshi Oda, Namerikawa; Hideyuki Matsushima, Toyama, all of Japan

[73] Assignee: Yoshida Kogyo K.K., Tokyo, Japan

[21] Appl. No.: 124,214

[22] Filed: Sep. 21, 1993

[30] Foreign Application Priority Data

Sep. 21, 1992 [JP] Japan ..... 4-072238 U

[51] Int. Cl.[6] ..... F16G 15/00

[52] U.S. Cl. ..... 24/116 A; 24/116 R; 24/616

[58] Field of Search ..... 24/116 A, 116 R, 24/616, 615, 618; 63/3, 4

[56] References Cited

U.S. PATENT DOCUMENTS

| | | | |
|---|---|---|---|
| 1,646,999 | 10/1927 | Goodridge | 63/3 |
| 1,650,506 | 11/1927 | Gagnon | 24/116 A |
| 1,769,245 | 7/1930 | Tregoning | 24/116 A |
| 1,791,507 | 2/1931 | Meyer | 24/116 A |
| 2,612,139 | 9/1952 | Collins | 63/3 |
| 2,650,398 | 9/1953 | Bangs | 24/616 |
| 3,120,042 | 2/1964 | Speranza et al. | 24/123 |
| 3,458,993 | 8/1969 | Greene | 24/116 A |

FOREIGN PATENT DOCUMENTS

| | | |
|---|---|---|
| 2229180 | 1/1974 | Germany . |
| 45-5454 | 3/1970 | Japan . |
| 2439 | 1/1992 | Japan . |
| 428292 | 7/1967 | Switzerland . |

*Primary Examiner*—Victor N. Sakran
*Attorney, Agent, or Firm*—Hill, Steadman & Simpson

[57] ABSTRACT

An attachment fitting in which several sets of ball chains can be arranged and the attachment is possible over the entire length of the attachment fitting main body. Also, the strength of the main body is improved.

A tubular main body has an opening on one end and can be closed on the other end. A slit is provided in the vicinity of the other end through the opening. A connecting member is provided and extends in the longitudinal direction of the main body which is symmetrical to the slit of the main body. Several protruding pieces are formed and jut out from the circumference of the closure so that the aforementioned opening can be shut. The end of ball of several sets of ball chains is fitted into the main body. A connecting rod of ball chain goes through slit. The attachment is closed through the opening by shutting the closure.

11 Claims, 5 Drawing Sheets

FITTING FOR BALL CHAINS

BACKGROUND OF THE INVENTION

This device pertains to a ball chain attachment fitting which is used for attaching a ball chain onto the slider of a slide fastener, keys, name plates and so forth.

Since the function of a pull tab is provided for attaching the ball chain to the slider of a slide fastener, the decorative value of the pull tab is more valuable if several ball chains are arranged and attached to only one body. Thus, the means of attaching the ball chain to objects is stated in Japanese Utility Model Publication Number 45-5454 or in Japanese Utility Model Application KOKAI (early publication) Number HEI 2-439 and so forth. In Publication 45-5454, each of the balls of the several sets of ball chains is inserted inside a pipe where a slit is provided and a connecting rod is inserted and attached through this slit. This pipe has a frame where both ends are bent into a U-shape and the ball fits into the curved ends and each of the balls is held in between these curved portions. On the other hand, in the aforementioned Publication 2-439, the attachment part is provided in the embracing portion of a cross sectional C shape, the ball is being held in the embracing portion, therefore to shut off the attachment, the opening of the embracing portion is closed and deforms almost into a spherical shape.

In the object which is stated in the aforementioned Publication 2-439, when the ball is inserted through the opening, the technique of shutting off the attachment by closing the opening is established, but it only describes the form of attaching 1 set of ball chains, and the matter of the arrangement and attachment of several sets of ball chain is not mentioned. On the other hand, the arrangement of several ball chains is described in Publication 45-5454 but like the aforementioned, the ball is held in the curved portion of the frame of the pipe but since the attachment of the ball chain to the curved portion of the frame is not over the whole length, the entire width of the ball chain that is arranged is narrower than the length of the frame. If it is only for decorative purposes such as a key holder, it would not be a problem but part of the ball chain is used as a tension member as in using the handle of a belt or a slider for a slide fastener. The magnitude of the tension is concentrated on the center of the embracing portion so therefore durability could be a problem.

In order to resolve the above mentioned problems, the purpose of this device is to offer a way in which several sets of ball chains can be attached to an attachment fitting. Thus, several sets of ball chains can be arranged and attached.

SUMMARY OF THE INVENTION

The ball chain attachment fitting is characterized with a main body in a tubular shape which opens on one end and has a bottom. Each of the balls in the several sets of ball chains fits into the inside of this said main body. A connecting member protrudes on the exterior of this main body which extends in the longitudinal direction. A connecting rod of the ball chain can be inserted in the longitudinal direction near the opening of this main body. A slit is provided in the vicinity of this closure of the opening. The closure parts are provided for enclosing the tube by shutting the opening of this main body.

Furthermore, in the above mentioned closure part, several protruding pieces which jut out from the exterior of the main body are formed and the tube is enclosed and shut as each of the protruding pieces are assembled together. Or in the enclosure part, a thick part is formed in the vicinity of the opening of the body. The tube is enclosed by shutting this thick part with another cap which fits inside the opening.

Also, as another means of resolving the aforementioned problems, the ball chain attachment fitting is characterized in that the tubular main body can be enclosed on both ends of the opening. Each of the balls in the several sets of ball chains fits into the inside of this said main body. A connecting member protrudes on the exterior of this body which extends in the longitudinal direction. A ball of the ball chain goes through the insertion opening that is provided and is placed in between both ends of the main body. In the vicinity of the insertion opening, there is a raised piece between both ends of the opening. These raised pieces act as the exterior wall of the main body when they are shut and the connecting rod of the ball chain can be inserted through the slit. A hollow space is formed with a small diameter for a ball of the ball chain in between the raised pieces.

If the fitting is constructed as mentioned above, that is, the connecting member protrudes out in the longitudinal direction and the ball chain can be attached in the longitudinal direction of the main body, the purpose of the aforementioned device can be achieved.

DETAILED DESCRIPTION OF THE PREFERRED EMBODIMENTS

Figure 1:
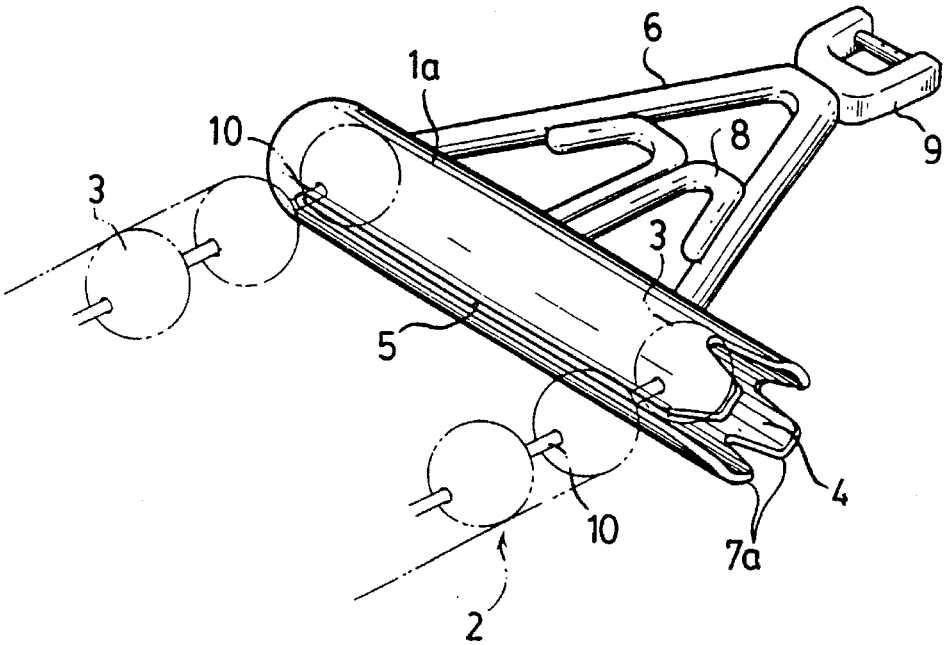
FIG. 1 is a perspective view of the ball chain attachment fixture of the present invention.
Figure 2:
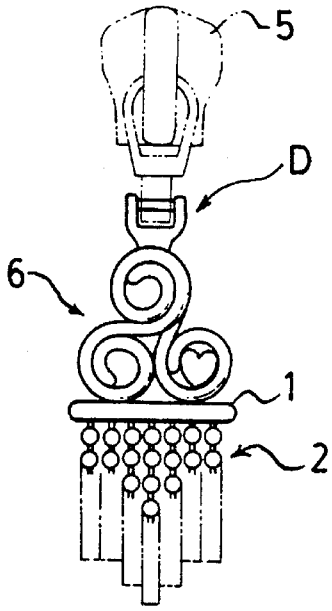
FIG. 2 is a front view of the present invention applied to a slider.

This device can explained in a more concrete fashion as follows. The attachment tool shown in FIG. 1 is a construction used as the handle D for the slider that is used for a slide fastener which is shown in FIG. 2.

The main body, 1*a* of the attachment tool is made up of a metal circular pipe which opens on one end at the bottom. Each of the balls 3 in the several sets of ball chains 2 fits into the inside of this said main body 1*a*. A connecting member 6 protrudes on the exterior of this main body 1*a* which extends in the longitudinal direction. A connecting rod 10 of the ball chain can be inserted in the longitudinal direction near the opening 4 of this main body 1*a*. A slit 5 is provided in the vicinity of this closure of the opening. The closure parts 7*a*, 7*b* are provided for enclosing the tube by shutting the opening 4 of this main body 1*a*. Also, the aforementioned connecting member 6 is equipped with a clamp part 9 with a decorative part in between it.

In the aforementioned ball chain 2, each ball 3 is connected in order with several connecting rods 10 through the hollow in the center. There is a space in between each of the connected balls 3.

Figure 3:
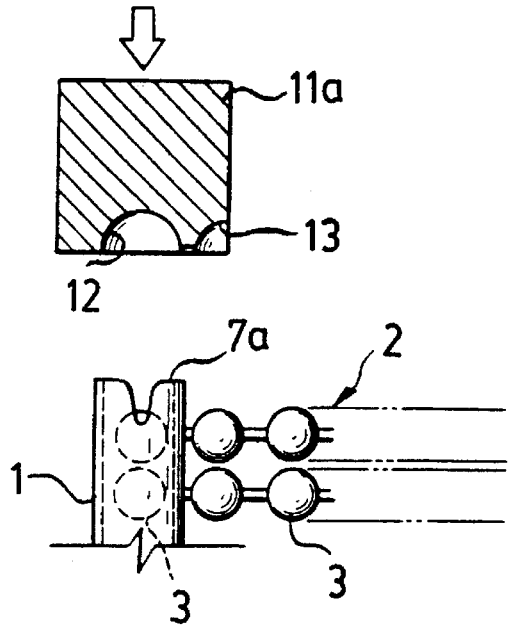
FIG. 3 is a front view showing ball chains fit into a main body.
Figure 4:
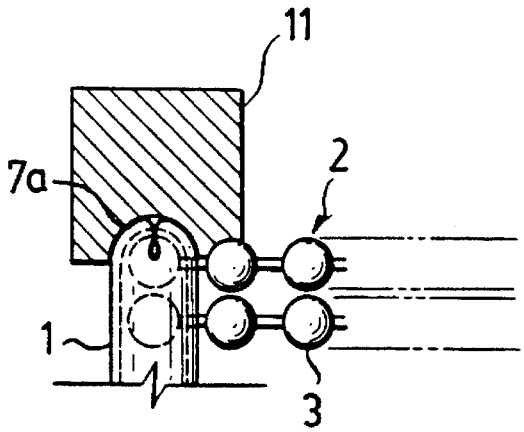
FIG. 4 is a front view of the arrangement of FIG. 3 in a further state of assembly.

The means for inserting the aforementioned ball chain 2 into the main body, 1*a* is as shown in FIGS. 3 and 4. Each end of ball 3 of the several sets of ball chain 2 is inserted gradually through the opening 4 of the main body 1*a* and each connecting rod 10 goes through the slit 5. Next, the closure part 7*a* of the opening 4 is closed with the metal shutters 11*a* and it is enclosed into a semi circle. Therefore, each protruding piece of the closure part 7 in the metal shutter 11*a* are bent into a semi-circle of the concave part 12. A part of the ball 3 of the ball chain 2 which is arranged together in the opening 4 is inserted with a concave part 13 that is provided.

Figure 5:
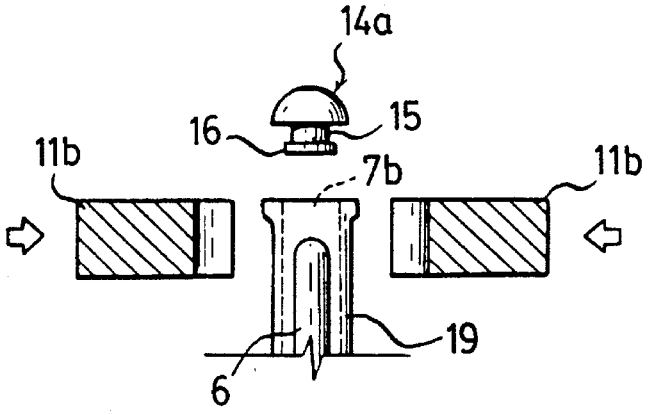
FIG. 5 is a sectional view of an alternate method of closing a main body.

The example shown in FIG. 5 is almost the same as the aforementioned example but the difference here is in the closure part 7*b*. That is, a thick part is formed which protrudes outward in the vicinity of the opening 4 of the main body 1*a*. A cap 14*a* fits into this opening and by shutting the cap 14*a*, the cap is fixed to the main body 1*a*. Furthermore, in the cap 14*a*, a bottom part 15 protrudes into the head of the semi circle and a flange 16 is provided on the bottom part 15.

Figure 6:
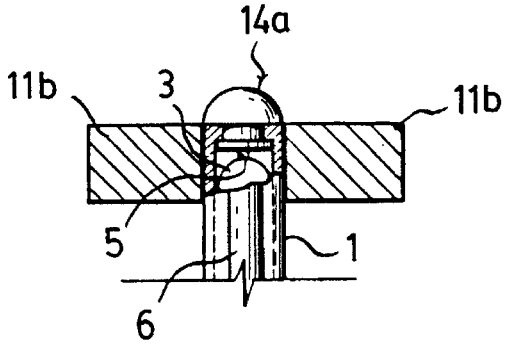
FIG. 6 is a sectional view of the arrangement of FIG. 5 in a further stage of assembly.
Figure 7:
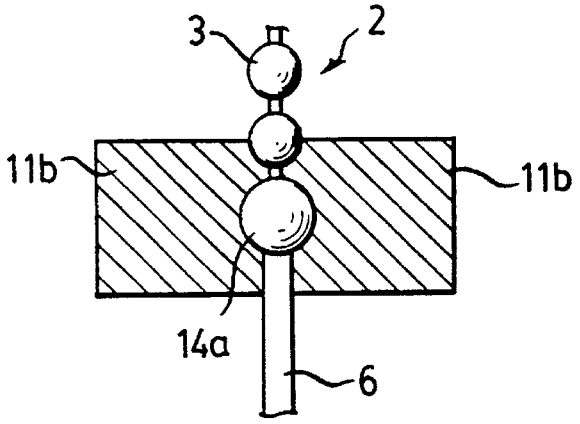
FIG. 7 is a top plan view of the arrangement of FIG. 6.

The means of fixing and shutting the above mentioned cap 14*a* onto the opening 4 of the main body 1*a* are as shown in FIGS. 5 and 6. The cap 14*a* fits onto the opening 4. The thickly formed part 7 of the opening 4 is shut with a pair of left and right metal shutters 11*b*. Due to the plastic deformation of the thickly formed closure 7*b*, it wedges and attaches into the space between the head of cap 14*a* and the flange 16.

Figure 8:
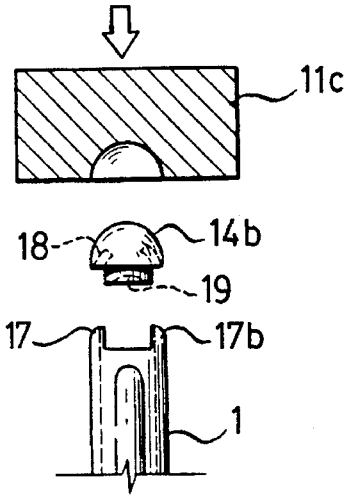
FIG. 8 is a front view of an alternate method of closing the main body.
Figure 9:
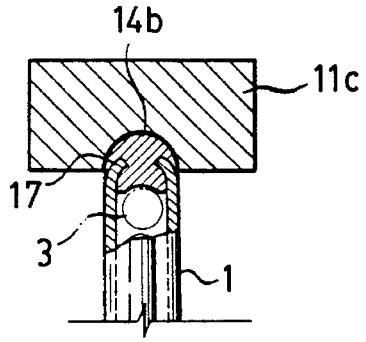
FIG. 9 is a sectional view of the arrangement of FIG. 8 in a further stage of assembly.

The example shown in FIG. 8 and FIG. 9 is the deformation example shown in the aforementioned FIG. 5. There is a pair of protruding pieces 17 which protrude symmetrically around the circumference of the opening 4 of the main body 1*a*. Cap 14*b* fits onto this opening. The bottom part 15 protrudes into the head portion. The aforementioned protruding piece 17 is bent and fitted onto the head portion. A groove 18 is provided on the cap. A part of ball 3 fits into the lower portion of the bottom part 15. A connecting part 19 is provided. Cap 14*b* is attached entirely onto the main body 1*a* by shutting with the metal shutters 11*c*.

Figure 10:
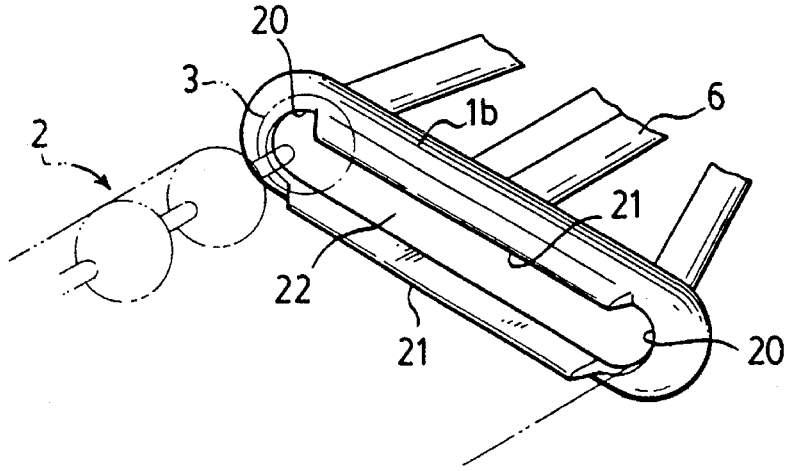
FIG. 10 is a perspective view of an alternate embodiment of the invention.

Next, the main body 1*b* of the example shown in FIG. 10 is made up of a circular tube which closes into a semi circle on both openings. The connecting member 6 is provided in a similar way as mentioned before. An insertion opening 22 is provided between two raised pieces 21, 21 which becomes the wall of the main body 1*a* when it is closed. In the main body 1*a* are two hollow spaces 20, 20 which are provided. Furthermore, after the insertion of ball 3 through the insertion opening 22, the aforementioned raised pieces 21, 21 return to their original state; but when the connecting rod 10 of the ball chain 2 goes through the opening between the raised pieces 21, 21, the opening forms into the width of slit 5.

Figure 11:
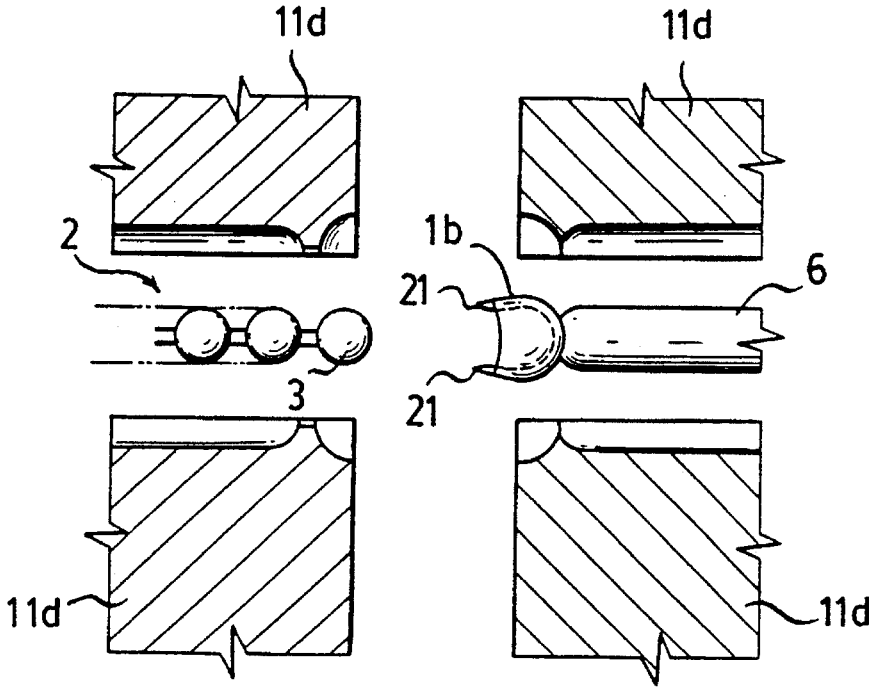
FIG. 11 is a sectional view of a method of assembling the main body and ball chains shown in FIG. 10.
Figure 12:
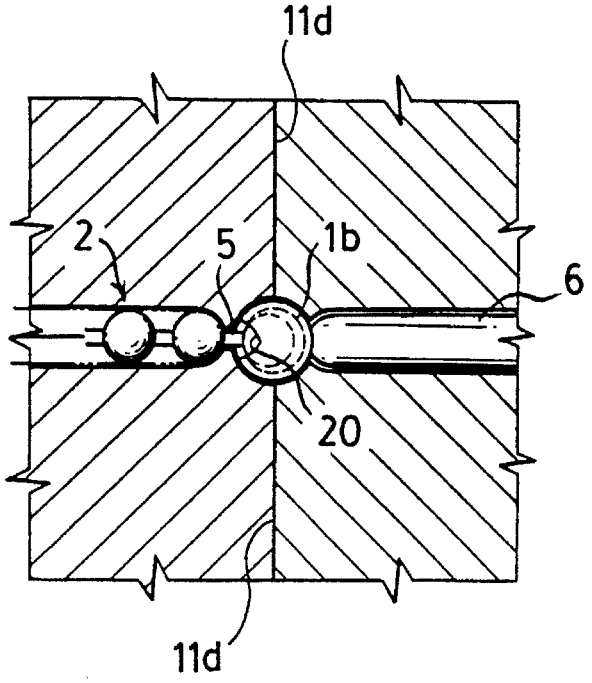
FIG. 12 is a sectional view of the arrangement of FIG. 11 in a further stage of assembly.

The means of attaching the ball chain 2 onto the main body 1*b* of the above mentioned attachment tool is as shown in FIG. 11 and FIG. 12. There is a pair of left and right vertical metal piece 11*d*, 11*d*. The ball chain 2 is held in the metal piece 11*d* and the main body 1*b* is held in the other metal piece 11*d*. Thus, the metal pieces are placed in this kind of arrangement. The end of each ball 3 fits into the main body 1*b* through the insertion opening 22. Next, the insertion opening is cleared or closed by slit 5 with the raised pieces 21, 21. Ball chain 2 is connected to the main body 1*b*. Furthermore, both the hollow ends 20, 20 similar to the aforementioned are also semicircular and the remaining half portion is closed off by the raised pieces 21, 21 therefore, since the hollow spaces 20 are symmetrical, the ball chain 2 does not fall off.

According to the ball chain attachment fitting of this device, the main tubular body can be closed on one end and opened on the other end. A connecting member protrudes in the longitudinal direction on the exterior of this main body. A slit is provided in the vicinity of the closing end through the opening which is positioned symmetrically in the tube. The closing parts are provided for shutting off the opening. The end of the ball in the ball chain fits into this main body. A connecting rod of the ball chain goes through this slit. Attachment is possible through the shutting of the closure parts. The ball chains can be attached across the whole length of the main body. However, since a connecting member is provided in the longitudinal direction, tension is provided at the side of the ball chain. Partial load is not applied to the main body. A uniformly distributed load is applied to the main body. Durability is thus improved with respect to the strength. Also, since the slit is provided near the edge of the main body, ball chain attachment is possible and the entire length of the ball chain and the length of the main body is almost the same. This provides good forming.

In addition, if the raised pieces are placed in between both edges of the main body and with the hollow space provided on both ends of the main body, both ends can be closed. Since the raised pieces are located in the center of the main body, shutting becomes easier. The ball chain can be maintained better in between both ends of the main body.

We claim as our invention:

1. A ball chain fitting comprising an elongated hollow ball containing part closed at least at one end thereof and a connecting member fixed to said ball containing part, said ball containing part having inside dimensions fit for terminal balls of a plurality of ball chains to be inserted therein and, at the same time, being provided with a slit formed in said ball containing part as extended substantially throughout the entire length thereof on the side opposite to the side used for fixation of said connecting member and further with an insertion mouth communicating with said slit, said slit having a width enough for insertion therethrough of a string of each ball chain, and said insertion mouth having a size enough for insertion therethrough of said ball and being so adapted as to be closed after the terminal balls of said plurality of ball chains having been inserted into said ball containing part;

wherein said ball containing part is formed of a cylindrical member having one end closed and the other end opened whose opening forms said insertion mouth;

and further comprising a sealing member serving to seal said other end; and wherein said cylindrical member is provided with a rim part of increased wall thickness formed on said other end, and said sealing member is composed of a hemispherical head part of a size enough to cover said opening of the cylindrical member and a leg part projected from said head part, said leg part being provided at the leading end thereof with an outwardly expanded flange part such that when the other end of said cylindrical member having the sealing member inserted therein is squeezed by pressing, said rim part will be plasticly deformed and pressed into a gap between the head part of said sealing member and said flange part.

2. A ball chain fitting comprising an elongated hollow ball containing part closed at least at one end thereof and a connecting member fixed to said ball containing part, said ball containing part having inside dimensions fit for terminal balls of a plurality of ball chains to be inserted therein and, at the same time, being provided with a slit formed in said ball containing part as extended substantially throughout the entire length thereof on the side opposite to the side used for fixation of said connecting member and further with an insertion mouth communicating with said slit, said slit having a width enough for insertion therethrough of a string of each ball chain, and said insertion mouth having a size enough for insertion therethrough of said ball and being so adapted as to be closed after the terminal balls of said plurality of ball chains having been inserted into said ball containing part;

wherein said ball containing part is formed of a cylindrical member having one end closed and the other end opened whose opening forms said insertion mouth;

and further comprising a sealing member serving to seal said other end; and wherein said cylindrical member is provided with projecting pieces rising from edge of said other end, and said sealing member is composed of a hemispherical head part of a size enough to cover said opening of the cylindrical member and a leg part projected from said head part, said head part being provided in the rear surface thereof with an engaging groove for admitting said projecting pieces therein in a bent state.

3. A ball chain fitting according to claim 1 or claim 2, wherein said leg part is provided in the lower end surface thereof with a depressed part of a size for accommodating part of said ball.

4. A ball chain fitting according to claim 5, further comprising clamping means fixed to a leading part of said connecting member for connecting said fitting to some other article.

5. A ball chain fitting comprising an elongated hollow ball containing part closed at least at one end thereof and a connecting member fixed to said ball containing part, said ball containing part having inside dimensions fit for terminal balls of a plurality of ball chains to be inserted therein and, at the same time, being provided with a slit formed in said ball containing part as extended substantially throughout the entire length thereof on the side opposite to the side used for fixation of said connecting member and further with an insertion mouth communicating with said slit, said slit having a width enough for insertion therethrough of a string of each ball chain, and said insertion mouth having a size enough for insertion therethrough of said ball and being so adapted as to be closed after the terminal balls of said plurality of ball chains having been inserted into said ball containing part;

wherein said ball containing part is formed of a cylindrical member closed in both opposite end parts thereof, and said cylindrical member is provided substantially throughout the entire length thereof with an elongate insertion mouth extended so as to extend between the opposite end parts and along longitudinal edges of said insertion mouth with erect pieces such as to give rise to a slit of a width fit for passage therethrough of a connecting string of each ball chain when said erect pieces are closed by pressing.

6. A ball chain fitting according to claim 5, wherein opposite terminals of said insertion mouth are semicircularly shaped.

7. A ball chain fitting comprising a hollow cylindrical member having one end closed and the other end opened, a connecting member fixed to said cylindrical member, and a sealing member serving to seal said open end of the cylindrical member, said cylindrical member having inside dimensions fit for terminal balls of a plurality of ball chains to be inserted therein through aid open end and, at the same time, being provided on the side opposite to the side used for fixation of said connecting member with a slit extending from the open end through the proximity of the closed end part, said slit having a width enough for insertion therethrough of a string of each ball chain;

wherein said cylindrical member is provided with a rim part of increased wall thickness formed on said open end, and said sealing member is composed of a hemispherical head part of a size enough to cover said opening of the cylindrical member and a leg part projected from said head part, said leg part being provided at the leading end thereof with an outwardly expanded flange part such that when the open end of said cylindrical member having the sealing member inserted therein is squeezed by pressing, said rim part will be plasticly deformed and pressed into a gap between the head part of said sealing member and said flange part.

8. A ball chain fitting comprising a hollow cylindrical member having one end closed and the other end opened, a connecting member fixed to said cylindrical member, and a sealing member serving to seal said open end of the cylindrical member, said cylindrical member having inside dimensions fit for terminal balls of a plurality of ball chains to be inserted therein through aid open end and, at the same time, being provided on the side opposite to the side used for fixation of said connecting member with a slit extending from the open end through the proximity of the closed end part, said slit having a width enough for insertion therethrough of a string of each ball chain;

wherein said cylindrical member is provided with projecting pieces rising from an edge of said open end, and said sealing member is composed of a hemispherical head part of a size enough to cover said opening of the cylindrical member and a leg part projected from said head part, said head part being provided in the rear surface thereof with an engaging groove for admitting said projecting pieces therein in a bent state.

9. A ball chain fitting according to claim 8, wherein said leg part is provided in the lower end surface thereof with a depressed part of a size for accommodating part of said ball.

10. A ball chain fitting comprising a hollow cylindrical member closed in both opposite end parts thereof and a connecting member fixed to said cylindrical member, said cylindrical member having inside dimensions fit for terminal balls of a plurality of ball chains to be inserted therein and being provided on the side opposite to the side used for fixation of said connecting member substantially throughout the entire length thereof with an elongate insertion mouth extended between the opposite end parts and provided along longitudinal edges of said insertion mouth with erect pieces such as to give rise to a slit of a width fit for passage therethrough of a connecting string of each ball chain when said erect pieces are closed by pressing.

11. A ball chain fitting according to claim 10, wherein opposite terminals of said insertion mouth are semicircularly shaped.

* * * * *